US011118416B2

(12) United States Patent
Vu

(10) Patent No.: US 11,118,416 B2
(45) Date of Patent: Sep. 14, 2021

(54) LIFT AND TURNING DEVICE

(71) Applicant: Ensco International Incorporated, Wilimgton, DE (US)

(72) Inventor: Van Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 17/006,266

(22) Filed: Aug. 28, 2020

(65) Prior Publication Data

US 2021/0062594 A1 Mar. 4, 2021

Related U.S. Application Data

(60) Provisional application No. 62/893,741, filed on Aug. 29, 2019.

(51) Int. Cl.

| | |
|---|---|
| ***E21B 19/15*** | (2006.01) |
| ***E21B 19/00*** | (2006.01) |
| ***E21B 19/16*** | (2006.01) |

(52) U.S. Cl.

CPC ..... *E21B 19/155* (2013.01); *E21B 19/002* (2013.01); *E21B 19/006* (2013.01); *E21B 19/008* (2013.01); *E21B 19/165* (2013.01)

(58) Field of Classification Search

CPC ..... E21B 19/15; E21B 19/14; E21B 19/16; E21B 19/20

USPC ..... 414/22.51–22.71

See application file for complete search history.

(56) References Cited

U.S. PATENT DOCUMENTS

| | | | | |
|---|---|---|---|---|
| 3,025,918 | A | 3/1962 | Leven | |
| 4,445,579 | A | 5/1984 | Bello | |
| 5,174,389 | A | 12/1992 | Hansen | |
| 5,375,667 | A * | 12/1994 | Trevisani | E21B 15/00 175/52 |
| 6,543,551 | B1 | 4/2003 | Sparks et al. | |
| 8,851,202 | B2 * | 10/2014 | Salthaug | E21B 19/155 175/52 |
| 2010/0104401 | A1 | 4/2010 | Hopkins et al. | |

(Continued)

FOREIGN PATENT DOCUMENTS

| | | |
|---|---|---|
| FR | 2644508 | 9/1990 |
| GB | 2383812 | 12/2004 |

(Continued)

OTHER PUBLICATIONS

PCT Application No. PCT/US2020/048601 International Search Report and Written Opinion, dated Nov. 11, 2020, 11 pgs.

*Primary Examiner* — Lynn E Schwenning

(74) *Attorney, Agent, or Firm* — Fletcher Yoder, P.C.

(57) ABSTRACT

A device includes a first cavity sized to hold a first cassette of tubulars, a second cavity sized to hold a second cassette of tubulars, and a first lifting mechanism disposed in the first cavity. The first lifting mechanism when in operation lifts the first cassette of tubulars from a horizontal orientation to a vertical orientation with respect to a drill floor. The device also includes a second lifting mechanism disposed in the second cavity, wherein the second lifting mechanism when in operation lifts the second cassette of tubulars from the horizontal orientation to the vertical orientation and a drive mechanism that when in operation rotates the device by a predetermined amount to dispose the first cavity in a region directly proximate to the drill floor.

20 Claims, 8 Drawing Sheets

(56) References Cited

U.S. PATENT DOCUMENTS

| | | | | |
|---|---|---|---|---|
| 2013/0275100 | A1* | 10/2013 | Ellis | B25J 19/023 703/2 |
| 2013/0299244 | A1 | 11/2013 | Reddy et al. | |
| 2013/0330151 | A1 | 12/2013 | Orgeron | |
| 2015/0167407 | A1 | 6/2015 | Binder et al. | |
| 2016/0090796 | A1 | 3/2016 | Roodenburg et al. | |
| 2016/0305204 | A1 | 10/2016 | Childers et al. | |
| 2016/0319611 | A1 | 11/2016 | Chang et al. | |
| 2018/0010398 | A1* | 1/2018 | Vu | E21B 15/02 |
| 2018/0328123 | A1 | 11/2018 | Keogh et al. | |
| 2019/0078426 | A1* | 3/2019 | Zheng | E21B 19/008 |
| 2019/0128079 | A1* | 5/2019 | Omrani | E21B 44/02 |
| 2019/0226287 | A1 | 7/2019 | Trydal et al. | |

FOREIGN PATENT DOCUMENTS

| | | |
|---|---|---|
| KR | 20160102790 | 8/2016 |
| WO | 2020123399 | 6/2020 |

* cited by examiner

LIFT AND TURNING DEVICE

CROSS REFERENCE TO RELATED APPLICATIONS

This application is a Non-Provisional application claiming priority to U.S. Provisional Patent Application No. 62/893,741, entitled "Offshore Platform", filed Aug. 29, 2019, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

Piping or pipes (e.g., tubular pipes such as drill pipes) may be utilized in conjunction with accessing oil and gas drilling locations. As depths of reservoirs increase, needs for additional piping to reach the reservoirs increase as well. Storage systems for the storage of the pipes increasingly are utilized to provide a storage location that allows for rapid access to pipes that are combined into a pipe string (e.g., a plurality of coupled pipes) to access a well and/or as a storage location for pipes that are being detached from the pipe string. Techniques and systems that provide improved access to tubular pipes would be advantageous.

DETAILED DESCRIPTION

Figure 1:
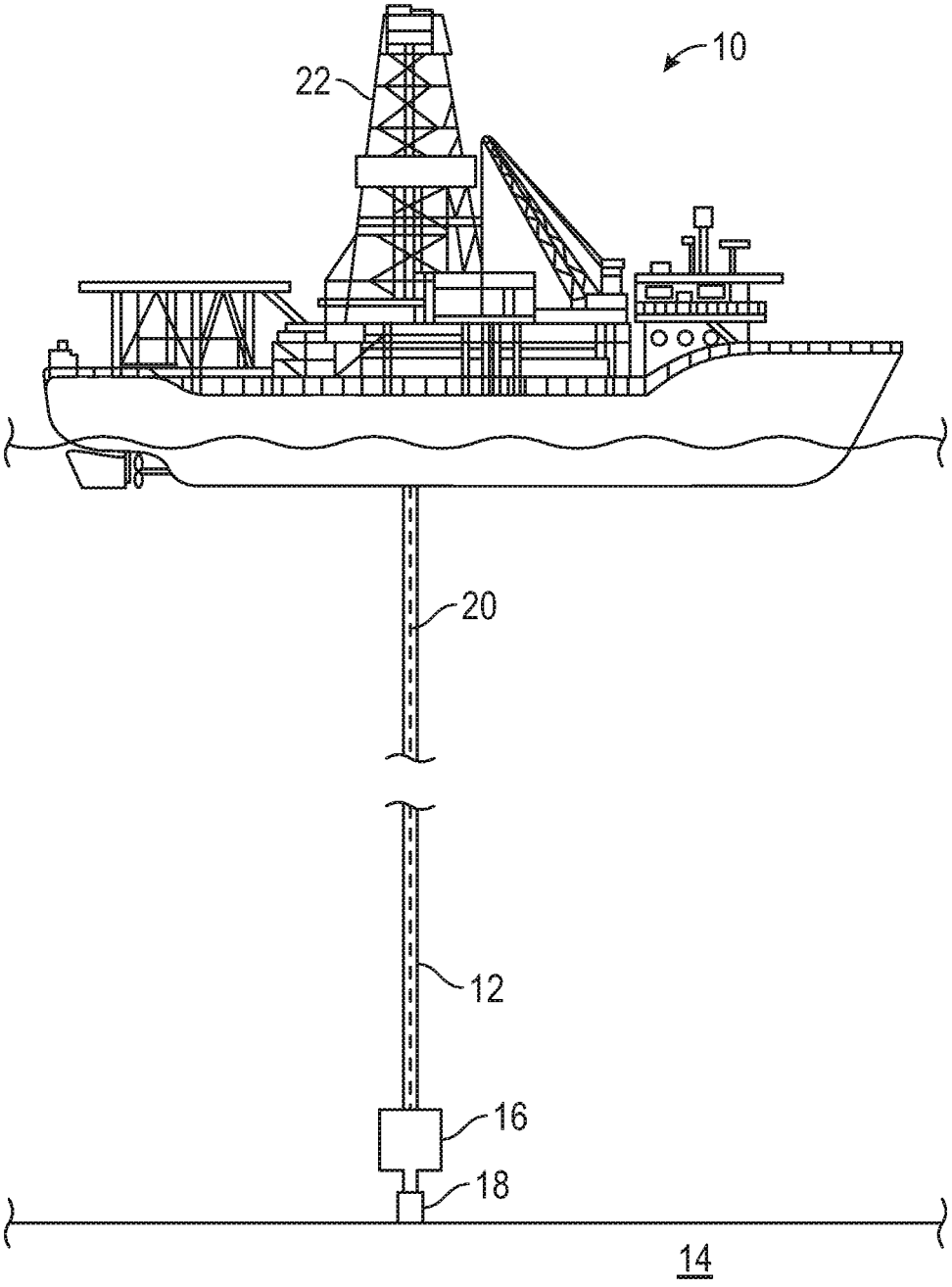
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Oil and/or gas drilling operations on land and offshore utilize frequent movement of piping or pipes (e.g., which may be connected together as a pipe string) in and out of a well bore to facilitate the drilling operations. The pipes may be tubular in shape and, in some embodiments, may be drill pipes. The pipes may be mechanically coupled to one another and decoupled from one another as performed in various drilling operations. Storage systems may be employed to store the pipes in a particular location for ease of access. Present embodiments described herein are directed to components, systems, and techniques utilized in the storage, transportation, and accessibility of pipes used in oil and gas operations (e.g., drill pipes) or other tubular members (e.g., risers).

In particular, the present application describes enhanced techniques and components for the handling of tubulars (e.g., pipes, such as drill pipes, risers, or the like), for example, how the pipes are accessed and/or setback. Portions of the present application describe techniques to support and otherwise hold tubulars, for example, when in a holding (i.e., a cassette) as well as to present them for use in operations. Additionally, the present application describes an automated process and a system to removal of tubulars to storage as well as retrieval of the tubulars from storage.

For example, embodiments described herein include devices and techniques for transfer of risers, drill pipe, and other tubular members to a drill floor of an oil and/or gas rig, which may be either onshore or offshore. The tubulars can be delivered in a housing (e.g., a cassette) from which the tubulars may be extracted. The cassette is inserted into a bottom portion of a lift and turning device (e.g., a lift and turn handler) where it is latched to a lifting mechanism. The lifting mechanism operates to lift the cassette from a horizontal position to a vertical position while pulling the cassette into an cavity of the lift and turning device. Once the cassette is in a vertical position inside of the cavity of the lift and turning device, the lift and turning device rotates, for example 180°, to place the tubulars in the drill floor region of the rig to provide access to the tubulars. This rotation of the lift and turning device also exposes an empty second cassette (in a second cavity of the lift and turning device now disposed away from the drill floor of the rig) and the lift and turning device reverses the lifting process to lower the empty second cassette from a vertical to a horizontal position. The empty second cassette is removed and a full third cassette is placed into the second cavity of the lift and turning device, lifted into a vertical position (from a horizontal position) and the lift and turning device rotates, for example 180°, to place the tubulars in the third cassette in the drill floor region of the rig to provide access to the tubulars. This rotation exposes the initial (now empty) cassette and it can be moved from a vertical to a horizontal position and removed from the lift and turning device. This process can also be reversed to place tubulars into empty cassettes with full cassettes being removed for storage.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a jack-up platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems described herein may also be applied to and utilized in onshore drilling activities. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to respective to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a pipe string made up of pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18. Accordingly, present embodiments include the storage of pipes for use in oil and/or gas operations (e.g., vertically or at an incline, in the situation of directional or slant drilling) in which a pipe storage system may include a pipe retaining member that may operate to hold a pipe in a storage position.

Figure 2:
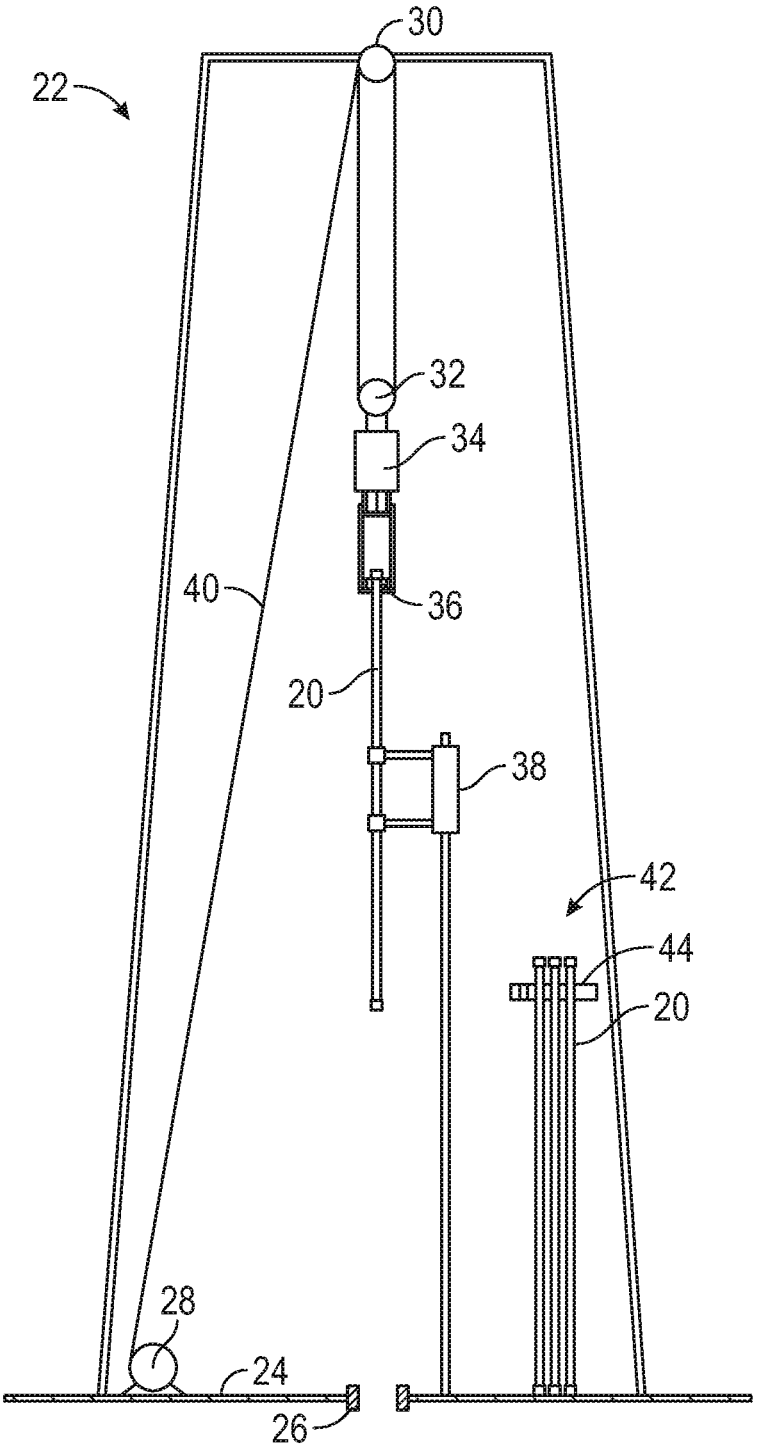
FIG. 2 illustrates a drill rig as illustratively presented in FIG. 1, in accordance with an embodiment.

One example of a system that utilizes stored pipe is depicted in FIG. 2. As illustrated, the drilling rig 22 may include a drill floor 24 disposed above the wellbore (e.g., the drilled hole or borehole of a well which may be proximate to the drill floor 24 in onshore operations or which may be, in conjunction with FIG. 1, below the wellhead 18 in offshore operations). Thus, the illustrated drilling rig 22 can be utilized in onshore operations. Likewise, the illustrated drilling rig can be utilized in offshore operations (e.g., when disposed on an offshore platform 10). Regardless of the operating environment (e.g., onshore or offshore), the drilling rig 22 may perform operations in which tubulars (e.g., pipes 20, such as drill pipes) may be hoisted from or lowered into wellbore and, thus, may utilize a pipe storage system to hold the pipes to be disconnected or connected from a tubular (e.g., pipe) string. The pipes 20 may, for example, be drill pipes that weigh between approximately 2000 lbs. and 5000 lbs. or another weight.

As illustrated, the drilling rig 22 may also include one or more of floor slips 26 (e.g., to grip and hold a tubular such as pipe 20) and the drilling rig may utilize a roughneck or other device to facilitate the connection and disconnection of tubulars. In some embodiments, it is envisioned that a stand of tubular segments (e.g., two, three, or more tubular segments coupled together) may be the tubular segments being tripped-in or tripped-out. The drilling rig may further include drawworks 28, a crown block 30, a travelling block 32, a top drive 34, an elevator 36, and a pipe handling apparatus 38 (e.g., a pipe racker). In some embodiments, a roughneck may operate to couple and decouple tubular segments or other pipe 20 (e.g., couple and decouple pipe 20 or a strand of pipe 20 to and from a pipe string) while the floor slips 26 may operate to close upon and hold a pipe 20 and/or the drill string passing into the wellbore. The drawworks 28 may be a large spool that is powered to retract and extend drilling line 40 (e.g., wire cable) over a crown block 30 (e.g., a vertically stationary set of one or more pulleys or sheaves through which the drilling line 40 is threaded) and a travelling block 32 (e.g., a vertically movable set of one or more pulleys or sheaves through which the drilling line 40 is threaded) to operate as a block and tackle system for movement of the top drive 34, the elevator 36, and any pipe 20 (e.g., drill pipe) coupled thereto. In some embodiments, the top drive 34 and/or the elevator 36 may be referred to as a tubular support system or the tubular support system may also include the block and tackle system described above.

The top drive 34 may be a device that provides torque to (e.g., rotates) the drill string as an alternative to the a rotary and the elevator 36 may be a mechanism that may be closed around a pipe 20 or other tubular segments (or similar components) to grip and hold the pipe 20 or other tubular segments while those segments are moving vertically (e.g., while being lowered into or raised from a wellbore) or directionally (e.g., during slant drilling). The pipe handling apparatus 38 may operate to retrieve a pipe 20 and position the pipe 20 during operations (e.g., tripping operations) from a storage location (e.g., a pipe storage system 42, which may operate as a pipe stand or a pipe rack). The pipe handling apparatus 38 may also operate to retrieve a pipe 20 or other tubular segment from a pipe string or tubular string and transfer the pipe 20 or tubular segment to the pipe storage system 42 for storage therein. The pipe storage system 42 may include, for example, a pipe support assembly 44 that operates as a lateral support for portions of the stored pipes 20. The pipe support assembly 44 may be, for example, a fingerboard, bellyboard, a monkeyboard, or the like. Additionally, two or more pipe support assemblies 44 may be utilized at differing vertical heights above the drill floor 24 to provide lateral support at various points for the stored pipes 20.

Figure 3:
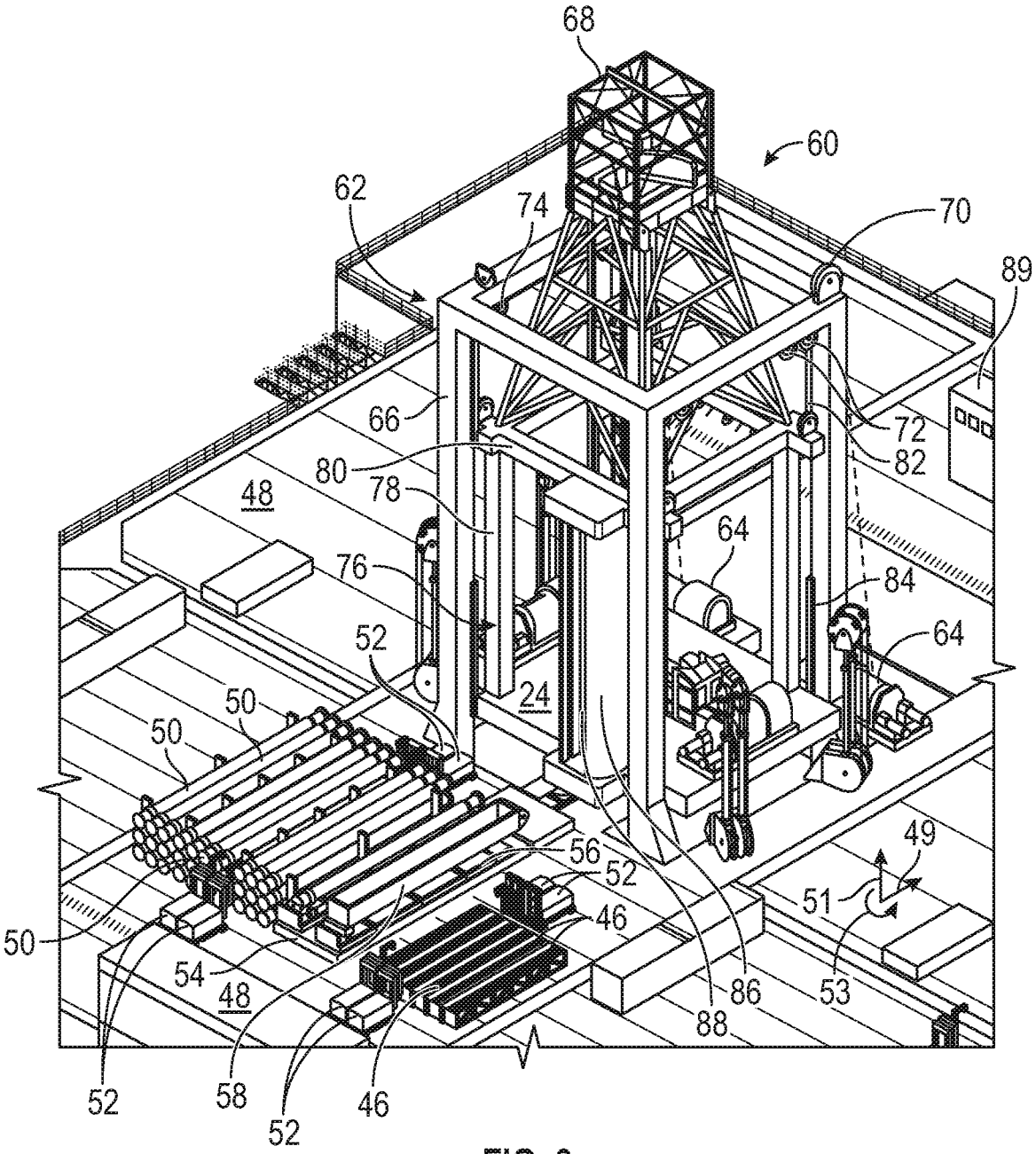
FIG. 3 illustrates an isometric view of a second embodiment of a drill rig as illustratively presented in FIG. 1, in accordance with an embodiment.

Other types of tubular storage exist. For example, as illustrated in FIG. 3, pipes 20 may be housed in a tubular housing 46 (e.g., a cassette) that may be placed, for example, horizontally (e.g., along a horizontal axis 49) on the deck 48. It should be noted that the deck 48, as illustrated, is on an offshore platform 10. However, this is for illustrative purposes only and it should be noted that the discussions of FIGS. 3-10 below can also be applied to onshore environments. In some embodiments, the pipes 20 may be arranged in a single line across the tubular housing 46 or the pipes 20 may be stacked in two or more rows in the tubular housing 46. Pipes 20 may be shipped as a complete set in the tubular housing 46 and deposited onto the offshore platform 10 (or land based drill site) for storage into an offline storage area (i.e., away from the drill floor 24). Techniques and systems described herein are directed to, at least in part, delivering the tubular housing 46 of pipes 20 to the drill floor 24 for utilization. However, it should also be noted that the techniques described herein are also applicable to other tubulars, for example, risers 50 that are used to make up riser string 12.

In some embodiments, the tubular housing 46 may include at least one face that may be open. In some embodiments, one or more removable tethers, straps, or other components can be applied across or along the face of the tubular housing 46 to maintain the position of the pipes 20 while in the tubular housing 46. Additionally and/or alternatively, a pipe support may be disposed along an upper face of the tubular housing 46 (i.e., whereby the upper face will be oriented vertically away from the drill floor 24 when the tubular housing 46 is placed thereon in a vertical orientation). Additionally and/or alternatively, a pipe support may be disposed along a lower face of the tubular housing 46 (i.e., whereby the lower face will be oriented vertically towards and/or on the drill floor 24 when the tubular housing 46 is placed thereon in a vertical orientation). The pipe support along the lower face of the tubular housing 46 may be stronger, thicker, stouter, or the like through the use of different materials or the use of a greater amount of material relative to a pipe support along the upper face of the tubular housing 46, since the pipe support along the lower face generally holds the weight of the pipes 20 when the tubular housing 46 is disposed in a vertical position (i.e., with respect to the drill floor 24) as well as provides lateral resistance to movement of the pipes 20 (i.e., provides lateral support to the pipes 20) while the pipe support along the upper face of the tubular housing 46 primarily provides lateral resistance to movement of the pipes 20 (i.e., provides lateral support to the pipes 20), but does not hold the weight of the pipes 20.

One of the above described pipe supports include or can be coupled to one or more plungers (i.e., a peg or other lateral restraint device that may be cylindrical or otherwise shaped) that that can be disposed in respective pipes 20 (e.g., in a box portion or another uppermost open portion of the pipe 20 when the tubular housing 46 is vertically disposed), for example, to aid in holding the pipes 20 laterally in position in the tubular housing 46 and/or when moving the tubular housing 46 to and from the drill floor 24. In some embodiments, a single pipe support may be coupled to the tubular housing 46 and individually houses or otherwise holds a respective plunger (i.e., one pipe support is used for each plunger). Alternatively, as illustrated, one pipe support may be coupled to the tubular housing 46 and houses or otherwise holds more than one plunger (i.e., one pipe support is used for a plurality of plungers).

The above described pipe support may include an insertion and retraction mechanism that allows for individual respective insertion and retraction of a single plunger into and out of a pipe 20. Alternatively, the pipe support may include an insertion and retraction mechanism retraction that allows for simultaneous and/or sequential insertion and simultaneous and/or sequential retraction of a more than one plunger. The insertion and retraction mechanism may be, for example, electrically, mechanically, or fluidly controlled. The insertion and retraction mechanism can be separate from (e.g., physically distinct from and/or disposed on) the pipe support. Alternatively, one or more components of the insertion and retraction mechanism can be integrated with the pipe support (i.e., a vertical support of the insertion and retraction mechanism that is moved vertically to cause the plunger to move into or out of physical contact with the pipe can be a portion of or extend from a horizontal beam of the pipe support).

Additionally, plunger may be used in conjunction with an auto doping technique and system, whereby pipe dope (e.g. a lubricant) is applied to the box portion or another uppermost open portion of the pipe 20 via the plunger. For example, the plunger, for example, can include therein a plenum, tubing, or another pipe dope delivery mechanism as well as, for example, one or more cavities disposed at a vertical bottom (i.e., towards the drill floor 24 when the tubular housing 46 is in a vertical position) and/or along one or more locations of a circumference of the plunger. Pipe dope may be injected or otherwise provided to the plunger (e.g., provided to the plenum or tubing) and expelled from the plunger via the cavity (or cavities) in the plunger to lubricate the box portion or another uppermost open portion of the pipe 20. The auto doping system may include a pipe dope repository, a channel to provide the pipe dope from the repository to the plungers, a pump or other mechanism to transmit the pipe dope from the repository, a channel to carry and the pipe dope from the repository to the plungers, and or other components. The auto doping system can be separate from (e.g., physically distinct from and/or disposed on) the pipe support. Alternatively, one or more components of the auto doping system can be integrated with the pipe support (i.e., the channel of the auto doping system can also be a beam or other support for the plunger(s)).

Holding bars may be utilized that allow the pipes 20 in the tubular housing 46 to maintain their position as plungers and plungers engage with the respective pipes 20. These holding bars may extend from the pipe support from an upper face towards a lower face of the tubular housing 46 and may surround a pipe 20. In some embodiments, two, three, four, or more holding bars may extend from the pipe support and may abut (i.e., the holding bars may circumscribe) pipe 20 to aid in maintaining the position of the pipe 20 (i.e., the holding bars may be arranged to support the pipe 20 in an x-y axis). These holding bars may, for example, prevent lateral movement in conjunction with the plungers so as to reduce the amount of force that the plungers exert.

The holding bars described above may alternatively and/or additionally extend and retract from one or more locations along the tubular housing 46 and/or from panels in the tubular housing 46 running parallel with the pipes 20 from the upper face to the lower face of the tubular housing 46. These holding bars operate in a similar manner to those discussed above with respect to the holding bars extending from one or more of the pipe supports. Regardless of the physical location of the holding bars described above, when the tubular housing 46 is transported to the drill floor 24, the holding bars are extended and engage the pipes 20, so that the plungers do not have to restrict lateral movement of the pipes 20 alone. When the tubular housing 46 is transported to a setback area (e.g., at or near a well center area of the drill floor 24) and when the tubular housing 46 is, for example, positioned in a vertical position (i.e., with an open face of the tubular housing 46 disposed towards or on the drill floor 24), the holding bars may retract so that holding pipes do not impair the pipe handling apparatus 38 from grabbing pipe (i.e., the plungers also are retracted as the pipe handling apparatus 38 grips a pipe 20 so as not to interfere with the operation of the pipe handling apparatus 38 in removing the pipe 20 from the tubular housing 46). An insertion and retraction mechanism can be utilized to allow for individual respective insertion and retraction of holding bars. Alternatively, the insertion and retraction mechanism retraction can allow for simultaneous and/or sequential insertion and simultaneous and/or sequential retraction of a more than one holding bar. The insertion and retraction mechanism may be, for example, electrically, mechanically, or fluidly controlled.

As additionally illustrated in FIG. 3, movement of the tubular housing 46 and/or the risers 50 can be accomplished via, for example, one or more robots 52. The one or more robots 52 can be, for example, multi-functional, battery-powered, autonomous, and capable of completion solo operations, or as part of a coordinated team with another of the one or more robots 52. In some embodiments, the one or more robots 52 includes a lift arm able to extend in a vertical direction along a vertical axis 51 (i.e., vertically towards and away from the deck 48). Additionally, the one or more robots 52 are able to move in a horizontal direction along the horizontal axis 49 (i.e., horizontally across the deck 48 and/or perpendicular to the vertical axis 51). The one or more robots 52 can also rotate in a circumferential direction 53 (i.e., circumferentially about the vertical direction along the vertical axis 51). Use of the one or more robots 52 may allow for automated movement of tubular housing 46 and/or risers 50 from their storage locations on the deck 48 to, for example, an enclosure handler 54.

The enclosure handler 54 may be a system that includes one or more one or more guide mechanisms 56 (e.g., guide tracks, skate tracks, or the like as well as mechanisms, such as direct acting cylinders or other internal or external actuation systems) that are used to move an enclosure 58 along the enclosure handler 54. In some embodiments, the enclosure 58 is sized to at least partially enclose (e.g., enclose on five of sides) the tubular housing 46. The enclosure 58 may include a support that contacts the tubular housing 46 (or the riser 50) to secure the tubular housing (or the riser 50) to the enclosure 58. This support may include a releasable latch, clip or other connection apparatus that may connect to the tubular housing and/or the riser 50.

FIG. 3 additionally illustrates an embodiment in which a drilling rig 60 similar to drilling rig 22 described above can be utilized. However, the drilling rig 60 may include an active heave compensation system 62, as described herein. The active heave compensation system 62 includes, for example, one or more active heave drawworks 64 and a fixed frame 66, which circumscribes at least one of the drill floor 24 and a derrick 68. In some embodiments, the one or more active heave drawworks 64 can be defined as an actuation system and/or the actuation system can employ other lifting components in place of or in addition to the one or more active heave drawworks 64. The one or more active heave drawworks 64 may be a large spool that is powered to retract and extend a line (e.g., wire cable or drill line) over a set of one or more pulleys or sheaves through which the line is threaded. The set of one or more pulleys or sheaves may be a cable and sheave arrangement similar to the block and tackle system described above and the line may be a single cable routed in the manner described below from a first active heave drawworks 64 to a second active heave drawworks 64 via the cable and sheave arrangement. Likewise, the line may be a single cable routed in the manner described below via the cable and sheave arrangement from a first active heave drawworks 64 to a connector (e.g., an anchor blot, eye bolt, screw eye, padeye, or another connector) coupled to, on, or in deck 48, which operates as an anchor point. In other embodiments, the active heave and compensation system 22 can include an actuation system that includes elements that operate in parallel, for example, a first line as a single cable routed in the manner described below from a first active heave drawworks 64 to a second active heave drawworks 64 via the cable and sheave arrangement and a second line as a second single cable routed in the manner described below from a third active heave drawworks 64 to a fourth active heave drawworks 64 via the cable and sheave arrangement (or a second cable and sheave arrangement). Likewise, a line may be a single cable routed in the manner described below via the cable and sheave arrangement from a first active heave drawworks 64 to a connector (e.g., an anchor blot, eye bolt, screw eye, padeye, or another connector) coupled to, on, or in deck 28, which operates as an anchor point and a second line may be a second single cable routed in the manner described below via the cable and sheave arrangement (or a second cable and sheave arrangement) from a second active heave drawworks 64 to a second connector (or the first connector) coupled to, on, or in deck 28, which operates as an anchor point. In this manner, parallel operations can be undertaken using the actuation system. Additionally, the active heave compensation system 62 may include the cable and sheave arrangement (e.g., the set of one or more pulleys or sheaves).

In some embodiments, the cable and sheave arrangement (e.g., the set of one or more pulleys or sheaves) coupled to the one or more active heave drawworks 64 may include, for example, one or more upper sheaves 70 disposed on an upper or topmost portion of the fixed frame 66. In one embodiment, a first upper sheave 70 is disposed on a topmost beam of the fixed frame 66 at a first corner of an upper portion of the fixed frame 66 and a second upper sheave 70 is disposed on the topmost beam of the fixed frame 66 at a second corner of an upper portion of the fixed frame 66. In some embodiments, there is an upper sheave 70 that corresponds to each active heave drawworks 64. Each of the one or more upper sheaves 70 may be disposed at a respective corner of the upper or topmost portion of the fixed frame 66 (e.g., a first upper sheave 70 disposed at a first upper corner of the fixed frame 66 and a second upper sheave 70 disposed at a second upper corner of the fixed frame 66), whereby the first and the second upper corners of the fixed frame 66 on which the upper sheaves 70 are disposed are adjacent to the active heave drawworks 64 (or physical connection or anchor point). The one or more upper sheaves 70 may receive the line directly from its respective active heave drawworks 64 (or from a physical connection or anchor point).

Additionally, the cable and sheave arrangement (e.g., the set of one or more pulleys or sheaves) may further include one or more lower sheaves 72 and one or more lower sheaves 74. The one or more lower sheaves 72 may be coupled to an underside of the upper or topmost portion of the fixed frame 66. In this manner, the one or more lower sheaves 72 may be disposed generally below (towards the deck 48) the one or more upper sheaves 70. For example, the one or more lower sheaves 72 can be disposed under (on a bottom side towards the deck 48) a beam or other support on which the one or more upper sheaves 70 is disposed. In some embodiments, one or more than one (e.g., two, three, or more) sheaves as the one or more lower sheaves 72 may be disposed below each of the one or more upper sheaves 70. For example, one or more lower sheaves 72 may be disposed at a respective corner of the upper or topmost portion of the fixed frame 66 (e.g., a first one or more lower sheaves 72 can be disposed at a first upper corner of the fixed frame 66 under a beam or other support on which a first upper sheave 70 is disposed, i.e., below the first upper sheave 70, and a second one or more lower sheaves 72 can be disposed at a second upper corner of the fixed frame 66 under a beam or other support on which a second upper sheave 70 is disposed, i.e., below the second upper sheave 70), whereby the first and the second upper corners of the fixed frame 66 on which the lower sheaves 72 are disposed are adjacent to the active heave drawworks 64 (or physical connection or anchor point).

Similarly, the one or more lower sheaves 74 may be coupled to the underside of the upper or topmost portion of the fixed frame 66. In some embodiments, one or more than one (e.g., two, three, or more) sheaves as the one or more lower sheaves 74 may be disposed along the underside of the upper or topmost portion of the fixed frame 66. The one or more lower sheaves 74 may also be disposed generally below (towards the deck 48) the one or more upper sheaves 70. For example, the one or more lower sheaves 74 can be disposed under (on a bottom side towards the deck 48) a beam or other support on which the one or more upper sheaves 70 is disposed. However, the one or more lower sheaves 74 may also be separated from the one or more upper sheaves 70 by the length of the fixed frame 66.

For example, one or more lower sheaves 74 may be disposed at a respective corner of the upper or topmost portion of the fixed frame 66 (e.g., a first one or more lower sheaves 74 can be disposed at a third upper corner of the fixed frame 66 under a beam or other support on which a first upper sheave 70 is disposed, i.e., below the first upper sheave 70 and at a distance of the length of the fixed frame 66 from the first upper sheave 70). Likewise, for example, a second one or more lower sheaves 74 can be disposed at a separate respective corner of the of the upper or topmost portion of the fixed frame 66 (e.g., a second one or more lower sheaves 74 can be disposed at a fourth upper corner of the fixed frame 66 under a beam or other support on which a first upper sheave 70 is disposed, i.e., below a second upper sheave 70 and at a distance of the length of the fixed frame 66 from the second upper sheave 70). Thus, a first one or more lower sheaves 72 and a first one or more of the lower sheaves 74 may be disposed on or coupled to the underside of the upper or topmost portion of the fixed frame 66 at a distance of the length of the fixed frame 66 so that each of the first one or more lower sheaves 72 and the first one or more of the lower sheaves 74 are disposed in respective upper corners of the fixed frame 66. Likewise, a second one or more lower sheaves 72 and a second one or more of the lower sheaves 74 may be disposed on or coupled to the underside of the upper or topmost portion of the fixed frame 66 at a distance of the length of the fixed frame 66 so that each of the first one or more lower sheaves 72 and the first one or more of the lower sheaves 74 are disposed in respective upper corners of the fixed frame 66. Thus, in one embodiment, each upper corner of the fixed frame 66 may have a set of one or more lower sheaves 72 or one or more lower sheaves 74 disposed thereat.

The active heave compensation system 62 further includes, for example, a heave compensation frame 76. The heave compensation frame 76 may be a structure that includes the drill floor 24 as a bottom portion, one or more structural beams 78 disposed, for example, along edges and/or at corners of the drill floor 24 and extending in the vertical direction along the vertical axis 51 (e.g., perpendicular to) away from the drill floor 24, and one or more upper beams 80 that extend in the horizontal direction along a horizontal axis 49 (e.g., perpendicular to the one or more structural beams 78) and are coupled to the structural beams 78. The heave compression frame 76 can be coupled a tubular string extending to the seafloor 14 and/or into a wellbore below the seafloor 14. For example, a drill string made up of drill pipes 20 may be held by the floor slips 26 of the drill floor 24, whereby the drill string extends to the seafloor 14 and/or into a wellbore below the seafloor 14. In some embodiments, the derrick 68 is disposed on the one or more upper beams 80. The heave compensation frame 76 is sized to fit within the fixed frame 66. The heave compensation frame 76 may be slidingly coupled to the fixed frame 66 such that the heave compensation frame 76 can move towards and away from the deck 48 while the fixed frame 66 remains stationary with respect to the deck 48. The fixed frame 66 may also restrict lateral movement (e.g., movement in the horizontal direction along the horizontal axis 49) of the heave compensation frame 76. In this manner, the heave compensation frame 76 is slidingly coupled to the fixed frame 66 (e.g., the heave compensation frame 76 is able to move in one plane with respect to the fixed frame 66 while being restricted from movement in a second plane with respect to the fixed frame 66).

In some embodiments, one or more guides (e.g., tracks or the like) may be used to couple the heave compensation frame 76 to the fixed frame 66. For example, an upper guide 82 may be disposed along each vertical support column of the fixed frame 66 and a lower guide 84 may be disposed along each vertical support column of the fixed frame 66 at a location below (e.g., towards the deck 48) the upper guide 82. In some embodiments, there may be one or more guides (e.g., an upper guide 82 and a lower guide 84) that correspond to each structural beam 78 of the heave compensation frame 76. In some embodiments, one or more lateral supports may be coupled to one or more of the drill floor 24, the one or more structural beams 78, and/or the one or more upper beams 80 to couple the heave compensation frame 76 to the fixed frame 66. In some embodiments, the one or more guides and the one or more lateral supports can be male and female connectors or other types of connectors. For example, the one or more lateral supports may be pads that may be made of Teflon-graphite material or another low-friction material (e.g., a composite material) that allows for motion of the heave compensation frame 76 relative to drill floor 24 with reduced friction characteristics. In addition to, or in place of the aforementioned pads, other lateral supports including, for example, bearing or roller type supports (e.g., steel or other metallic or composite rollers and/or roller bearings) may be utilized to allow for horizontal load transfer between the heave compensation frame 76 and the fixed frame 66 with minimal resistance to vertical motion (i.e., motion in the vertical direction along the vertical axis 51). The one or more lateral supports may allow the heave compensation frame 76 to interface with a the one or more guides so that the heave compensation frame 76 is movably coupled to the fixed frame 66. In this manner, the heave compensation frame 76 may be movably coupled to the fixed frame 66 to allow for movement of the heave compensation frame 76 (e.g., towards and away from the drill floor 24 while maintaining contact with the guide tracks or other support element of the fixed frame).

In some embodiments, the heave compensation frame 76 may be raised and lowered with the cable and sheave arrangement via one or more of the active heave drawworks 64. One technique for connecting the cable and sheave arrangement is described below; however it should be appreciated that alternate configurations are contemplated. In one embodiment, the line may be routed directly from a first active heave drawworks 64 of the one or more active heave drawworks 64 to a first one of the one or more upper sheaves 70 and passed to a connector (e.g., an anchor blot, eye bolt, screw eye, padeye, a pulley, or another connector) coupled to the heave compensation frame 76 (e.g., coupled to one of the one or more upper beams 80 at a first upper beam location) or passed to a sheave coupled to a connector coupled to the heave compensation frame 76. The line may then be routed to a first one of the one or more lower sheaves 72 at a first location (e.g., a first upper corner) of the fixed frame 66 and passed back to the connector (or the sheave coupled to the connector) of the heave compensation frame 76 if another of the one or more lower sheaves 72 is present at the first location. The line can then be routed to a second one of the one or more lower sheaves 72 at the first location (e.g., the first upper corner) of the fixed frame 66 when a second one of the one or more lower sheaves 72 is present at the first location (e.g., the first upper corner) of the fixed frame 66. The line may be routed from the second one of the one or more lower sheaves 72 to a first one of the one or more lower sheaves 74 at a second location (e.g., a second upper corner) of the fixed frame 66 when the second one of the one or more lower sheaves 72 is present at the first location (e.g., the first upper corner) of the fixed frame 66. Alternatively, the line may be routed from the first one of the one or more lower sheaves 72 to the first one of the one or more lower sheaves 74 at the second location (e.g., the second upper corner) of the fixed frame 66 when the second one of the one or more lower sheaves 72 is not present at the first location (e.g., the first upper corner) of the fixed frame 66.

The line may be routed from the first one of the one or more lower sheaves 74 at the second location (e.g., a second upper corner) of the fixed frame 66 to a second connector (e.g., an anchor blot, eye bolt, screw eye, padeye, a pulley, or another connector) coupled to the heave compensation frame 76 (e.g., coupled to one of the one or more upper beams 80 at a second upper beam location) or passed to a sheave coupled to the second connector. The line may then be routed from the second connector (or sheave coupled to the second connector) to a second one of the one or more lower sheaves 74 at the second location (e.g., the second upper corner) of the fixed frame 66 if another of the one or more lower sheaves 74 is present at the second location (e.g., the second upper corner) of the fixed frame 66. The line may be routed from the second one of the one or more lower sheaves 74 to a first one of the one or more lower sheaves 74 at a third location (e.g., a third upper corner) of the fixed frame 66 when the second one of the one or more lower sheaves 74 is present at the second location (e.g., the second upper corner) of the fixed frame 66. Alternatively, the line may be routed from the second connector back to the first one of the one or more lower sheaves 74 at the second location (e.g., the second upper corner) and then to a first one of the one or more lower sheaves 74 at the third location (e.g., the third upper corner) of the fixed frame 66 when the second one of the one or more lower sheaves 74 is not present at the second location (e.g., the second upper corner) of the fixed frame 66.

The line may be routed from the first one of the one or more lower sheaves 74 at the third location (e.g., the third upper corner) of the fixed frame 66 to a third connector (e.g., an anchor blot, eye bolt, screw eye, padeye, a pulley, or another connector) coupled to the heave compensation frame 76 (e.g., coupled to one of the one or more upper beams 80 at a third upper beam location) or passed to a sheave coupled to the third connector. The line may then be routed from the third connector (or sheave coupled to the third connector) to a second one of the one or more lower sheaves 74 at the third location (e.g., the third upper corner) of the fixed frame 66 if another of the one or more lower sheaves 74 is present at the third location (e.g., the third upper corner) of the fixed frame 66. The line may be routed from the second one of the one or more lower sheaves 74 to a first one of the one or more lower sheaves 72 at a fourth location (e.g., a fourth upper corner) of the fixed frame 66 when the second one of the one or more lower sheaves 74 is present at the third location (e.g., the third upper corner) of the fixed frame 66. Alternatively, the line may be routed from the third connector back to the first one of the one or more lower sheaves 74 at the third location (e.g., the third upper corner) and then to a first one of the one or more lower sheaves 72 at a fourth location (e.g., a fourth upper corner) of the fixed frame 66 when the second one of the one or more lower sheaves 74 is not present at the third location (e.g., the third upper corner) of the fixed frame 66.

The line may be routed from the first one of the one or more lower sheaves 72 at the fourth location (e.g., the fourth upper corner) of the fixed frame 66 to a fourth connector (e.g., an anchor blot, eye bolt, screw eye, padeye, a pulley, or another connector) coupled to the heave compensation frame 76 (e.g., coupled to one of the one or more upper beams 80 at a fourth upper beam location) or passed to a sheave coupled to the fourth connector. The line may then be routed from the fourth connector (or sheave coupled to the fourth connector) to a second one of the one or more lower sheaves 72 at the fourth location (e.g., the fourth upper corner) of the fixed frame 66 if another of the one or more lower sheaves 72 is present at the fourth location (e.g., the fourth upper corner) of the fixed frame 66. The line may be routed from the second one of the one or more lower sheaves 72 to the fourth connector (or sheave coupled to the fourth connector) and thereafter to a second one of the one or more upper sheaves 70 disposed at a second location on the fixed frame 66 at a distance approximately equal to the width of the fixed frame from the location of the first one of the one or more upper sheaves 70. Alternatively, the line may be routed from the second one of the one or more lower sheaves 72 to the second of the one or more upper sheaves 70 disposed at the second location on the fixed frame 66. Furthermore, when no second one of the one or more lower sheaves 72 is present the at the fourth location (e.g., the fourth upper corner) of the fixed frame 66, the line can be routed to the second of the one or more upper sheaves 70 disposed at the second location on the fixed frame 66 subsequent to being routed to the fourth connector by the first one of the one or more lower sheaves 72 at the fourth location (e.g., the fourth upper corner) of the fixed frame 66. The line can then be routed to the second active heave drawworks 64 of the one or more active heave drawworks 64 (if present) or to a connector (e.g., an anchor blot, eye bolt, screw eye, padeye, or another connector) coupled to, on, or in deck 48, which operates as an anchor point (if the second active heave drawworks 64 of the one or more active heave drawworks 64 is not present or is not being utilized).

Additionally, in some embodiments, the illustrated second active heave drawworks 64 of the one or more active heave drawworks 64 may operate as an anchor (e.g., locking the line to restrict its movement) while the first active heave drawworks 64 of the one or more active heave drawworks 64 extends and retracts the line to compensate for heave. Additionally and/or alternatively, the second active heave drawworks 64 of the one or more active heave drawworks 64 may operate in conjunction with the first active heave drawworks 64 of the one or more active heave drawworks 64 to extend and retract the line to compensate for heave, for example, to increase the speed at which the line can be extended and retracted. Furthermore, the second active heave drawworks 64 of the one or more active heave drawworks 64 may be removed and a connector (e.g., an anchor blot, eye bolt, screw eye, padeye, or another connector) coupled to, on, or in deck 48 may be added to operate as an anchor point for the line. Likewise, additionally and/or alternatively, one or more direct acting cylinders or other internal or external actuation device may be used to move the heave compensation frame 76 along the one or more guides (e.g., the upper guide 82 and the lower guide 84) in place of or in addition to the one or more active heave drawworks 64 as the actuation system.

Additionally illustrated in FIG. 3 is a lift and turn handler 86 (e.g. a lift and turning device and/or system). The lift and turn handler 86 may include a cavity 88 sized to fit the enclosure 58 inclusive of a tubular housing 46 (or the riser 50). In some embodiments, the lift and turn handler 86 may partially surround the enclosure 58 such that five of six sides of the enclosure 58 are at least partially surrounded by portions of the lift and turn handler 86, The remaining side of the enclosure 58 allow for pipes 20 therein to be exposed, for example, when the enclosure 58 is transported to a setback area (e.g., at or near a well center area of the drill floor 24) through rotation in the circumferential direction 53 of the lift and turn handler 86 by, for example, 180°. Alternate rotations in the circumferential direction 53 of the lift and turn handler 86 can also be made, for example, by approximately 100° 110° 120° 130° 140° 150° 160° 170° 190° 200° 210° 220° 230° 240° 250° 260° or another similar value or within a range of approximately 150°-210°, 160°-200°, 170°-190°, 175°-185°, or a similar value. The lift and turn handler 86 may include a cavity 88 sized to fit or hold the enclosure 58 (at least partially, for example at least approximately 50%, 60%, 70%, 80%, 90% or another percentage of the enclosure fits inside of the cavity 88). The lift and turn handler 86 can also include a second similar cavity 87 (as illustrated in FIG. 8) on an opposite side of the lift and turn handler 86, such that each cavity 87 and 88 is separated by a divider (e.g. a wall) running down approximately the center of the lift and turn handler 86. In this manner, when the lift and turn handler 86 rotates, for example by 180°, to transport the enclosure 58 (inclusive of the tubular housing 46 having pipes 20) to a setback area of the drilling rig 60, a second enclosure (inclusive of the tubular housing 46 having pipes 20 previously emptied therefrom) is exposed for subsequent removal and storage as the pipes 20 in the enclosure 58 transported to the setback area are available for removal, for example, as part of a tripping-in operation. Transport of pipes into the setback area utilizing the lift and turn handler will be described below in more detail with respect to FIGS. 4-10.

FIG. 3 also includes a control center 89 (e.g. a driller's cabin). In some embodiments, a computing system may control operation of at least the lift and turn handler 86. For example, control of an actuation system that controls rotation of the lift and turn handler 86, lift of the enclosure 58, and/or support of the enclosure 58 and/or control of one or more releasable couplings that allow for connection of the enclosure 58 to the lift and turn handler 86 may be directly or indirectly provided by the computing system. This computing system may be communicatively coupled to a separate main control system in the control center 89 whereby the main control system, for example provides a centralized control system for drilling controls, automated pipe handling controls, and the like. In other embodiments, the computing system that controls operation of at least the lift and turn handler 86 and may be a portion of the main control system (e.g., the control system present in the control center 89). Discussion of the computing system will be detailed below in conjunction with the discussion of FIG. 9.

Figure 4:
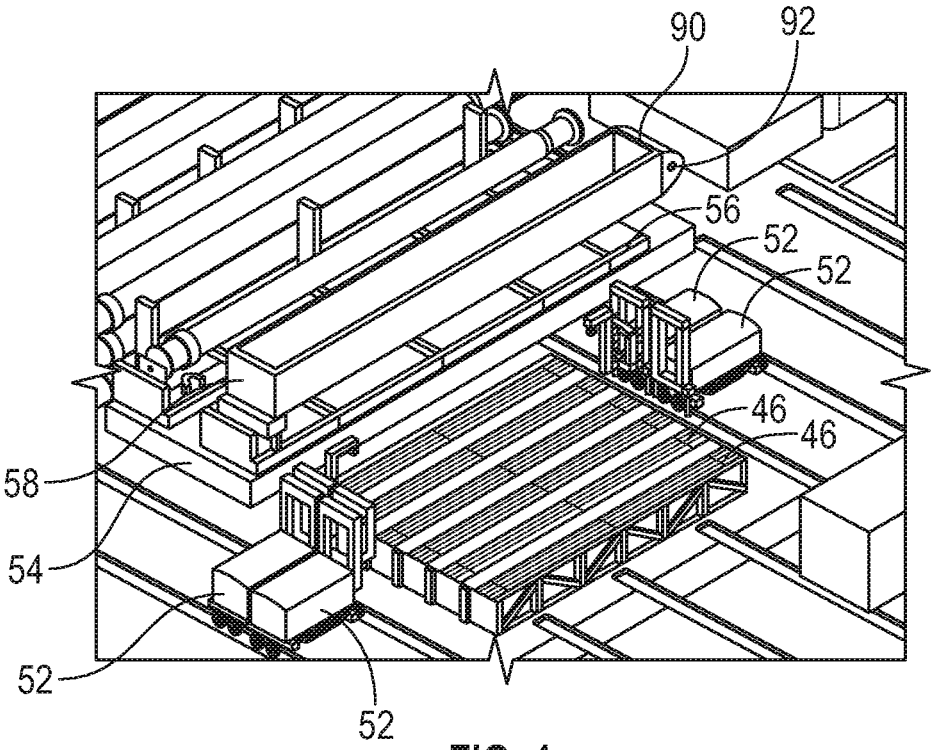
FIG. 4 illustrates an isometric view of an enclosure and the enclosure handler of FIG. 3, in accordance with an embodiment.
Figure 5:
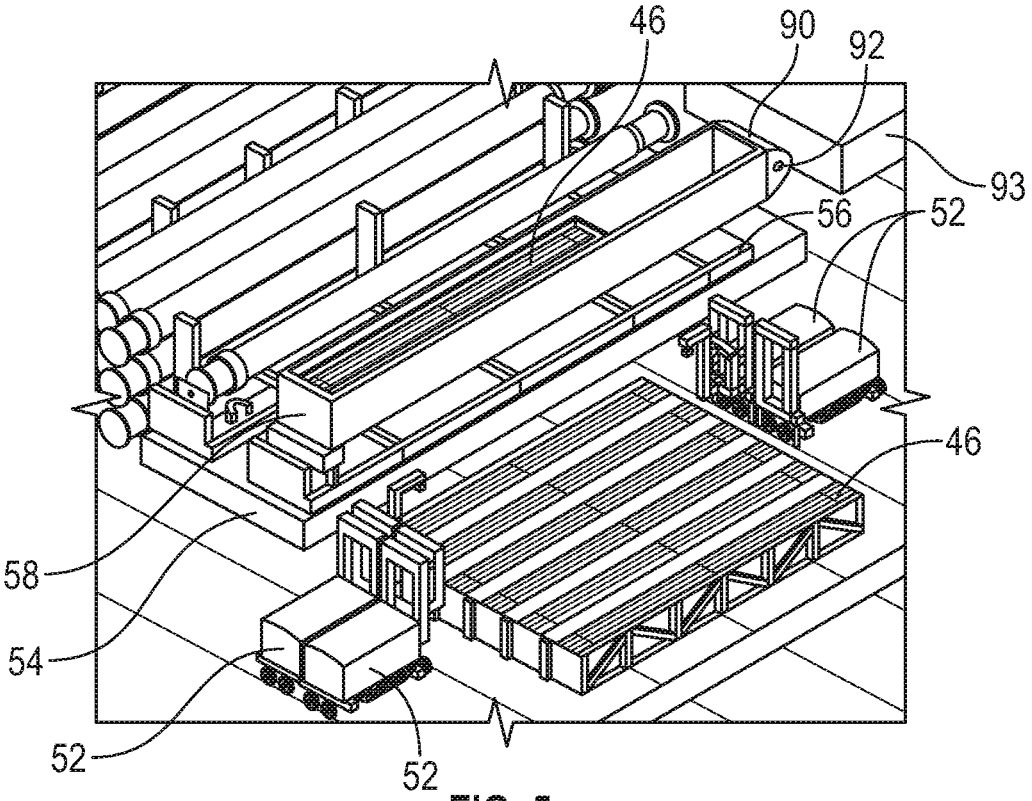
FIG. 5 illustrates an isometric view of a tubular housing in the enclosure of FIG. 3, in accordance with an embodiment.

FIG. 4 illustrates the enclosure handler 54 supporting the enclosure 58 in a first position and disposed in a horizontal direction along the horizontal axis 49. As illustrated, the enclosure 58 includes a topmost portion 90 as well as an interface 92 therein. As will be described below, the interface 92 may operate to couple the enclosure to the lift and turn handler 86. Furthermore, as illustrated in FIG. 4, the enclosure 58 is empty; no tubular housing 46 or riser 50 is disposed therein. The one or more robots 52 may operate to select a tubular housing 46 and place the tubular housing 46 in the enclosure 58, as illustrated in FIG. 5. The tubular housing 46 may be coupled to or otherwise secured to the enclosure 58 by, for example, one or more connectors that interface with the tubular housing 46. The one or more connectors may be a receptacle that receives a projection of tubular housing 46 (or vice versa) and may lock onto the projection (and that may be released, for example, via electrical, mechanical, and/or hydraulic control of the one or more connectors). Examples of the connection made may be a mechanical joint, such as a ball and socket joint or the like. Likewise, the one or more connectors may be a slot that narrows in a direction towards or away from the topmost portion 90 with gating elements, pins, steps, or the like that may affix a projection, for example, of the tubular housing 46 at a particular location. These gating elements, pins, steps, or the like may be releasable (e.g., via electrical, mechanical, and/or hydraulic control) to allow the projection, for example, of the tubular housing 46 to be removed from a connector of the enclosure 58.

Figure 6:
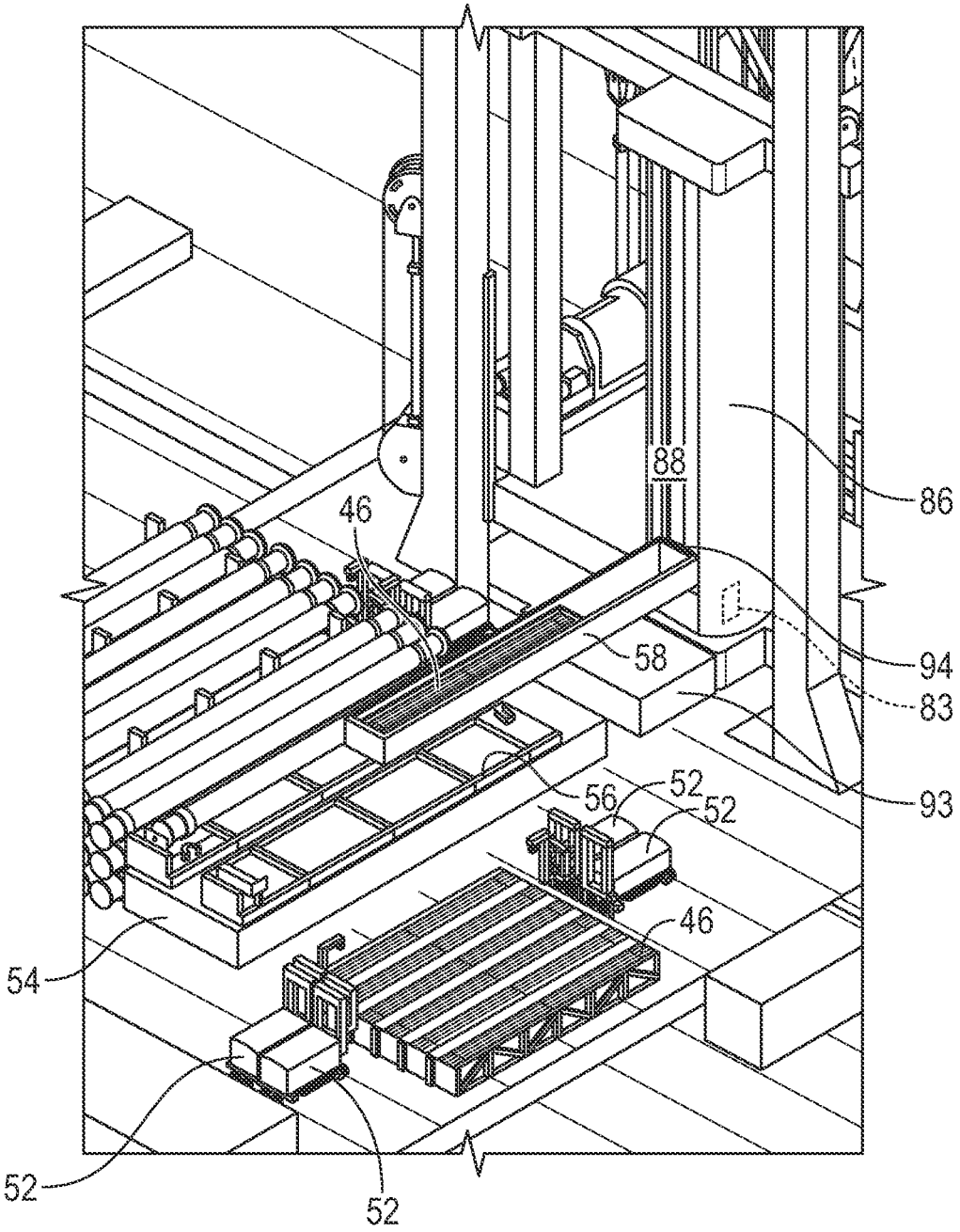
FIG. 6 illustrates an isometric view of the tubular housing in the enclosure of FIG. 5 in a lower portion of the lift and turn handler of FIG. 3, in accordance with an embodiment.

Thereafter, as illustrated in FIG. 6, the enclosure handler 54 may cause the enclosure 58 (inclusive of the tubular housing 46) to be moved in the horizontal direction along the horizontal axis 49 towards and into a bottom portion of the lift and turn handler 86. In some embodiments, the enclosure 58 in FIG. 6 is moved onto a transfer platform 93. If the drill floor 24 has been moved to a working elevation, the transfer platform 93 may also be moved to the working elevation so that the transfer platform 93 may be disposed at the same elevation as the drill floor 24 and, in some embodiments, their motions are synchronized.

In some embodiments, the enclosure 58 is coupled to or otherwise secured to the enclosure 58 by, for example, one or more connectors 94 of the lift and turn handler 86 that are coupled to interface 92. The one or more connectors 94 may be a pin or other projection that interlocks with the interface 92 (as a receptacle) of the enclosure 58 (or, the pins or projections may be the interface 92 and the receptacle may be the one or more connectors 94 disposed in the cavity 88 of the lift and turn handler 86). The one or more connectors 94 that couple with the interface 92 of the enclosure 58 may operate to provide lateral support to and/or restrict lateral movement of (e.g., movement in the horizontal direction along the horizontal axis 49) the enclosure 58.

In some embodiments, the one or more connectors 94 may be disposed on side portions of the cavity 88. Additionally, the one or more connectors 94 may be allow for a releasable connection with the interface 92 (e.g., a connection that is released via electrical, mechanical, and/or hydraulic control of the one or more connectors). Examples of the connection made may be a mechanical joint, such as a ball and socket joint or the like. Likewise, the one or more connectors 94 may include a slot that narrows in a direction towards or away from the topmost portion 90 with gating elements, pins, steps, or the like that may affix a projection, for example, the interface 92. These gating elements, pins, steps, or the like may be releasable (e.g., via electrical, mechanical, and/or hydraulic control) to allow the projection, for example, of the enclosure 58 to be removed from the one or more connectors 94 of the turn and lift device 86.

Furthermore, the one or more connectors 94 may be a portion of a track or may be connected to an actuation device and or an actuation system (e.g., a lifting mechanism) 83 that allows for the one or more connectors 94 to be lifted in the vertical direction along the vertical axis 51 and to, accordingly, lift the enclosure 58. In other embodiments, a separate track may be coupled to and may actuate (e.g., lift) the enclosure 58. The actuation device and/or system 83 may include one or more direct acting cylinders or other internal or external actuation devices that may be used to lift the enclosure 58, for example, along one or more guides, a track, or another path in the vertical direction along the vertical axis 51.

Figure 7:
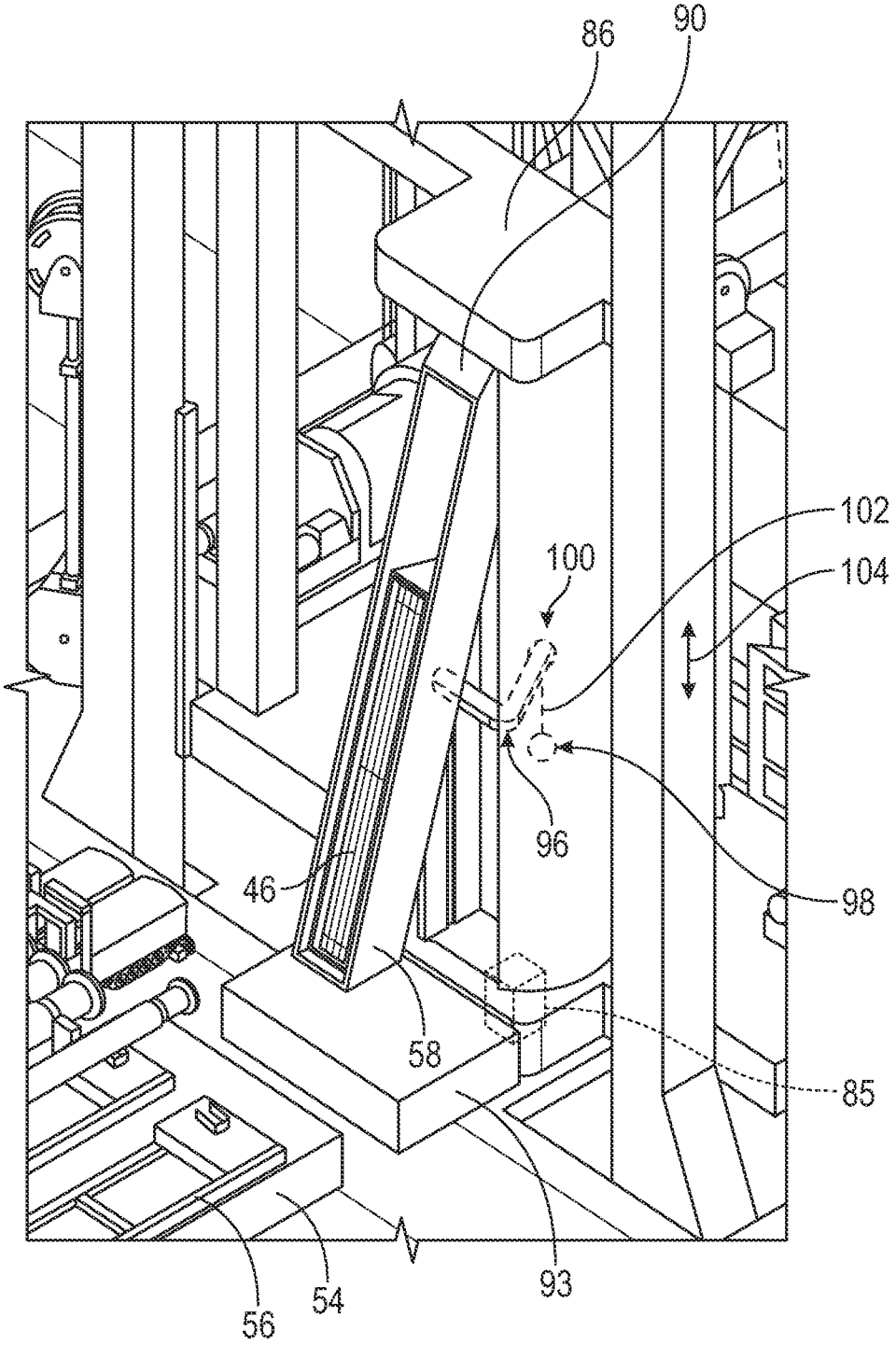
FIG. 7 illustrates an isometric view of the tubular housing in the enclosure of FIG. 5 in an upper portion of the lift and turn handler of FIG. 3, in accordance with an embodiment.
Figure 8:
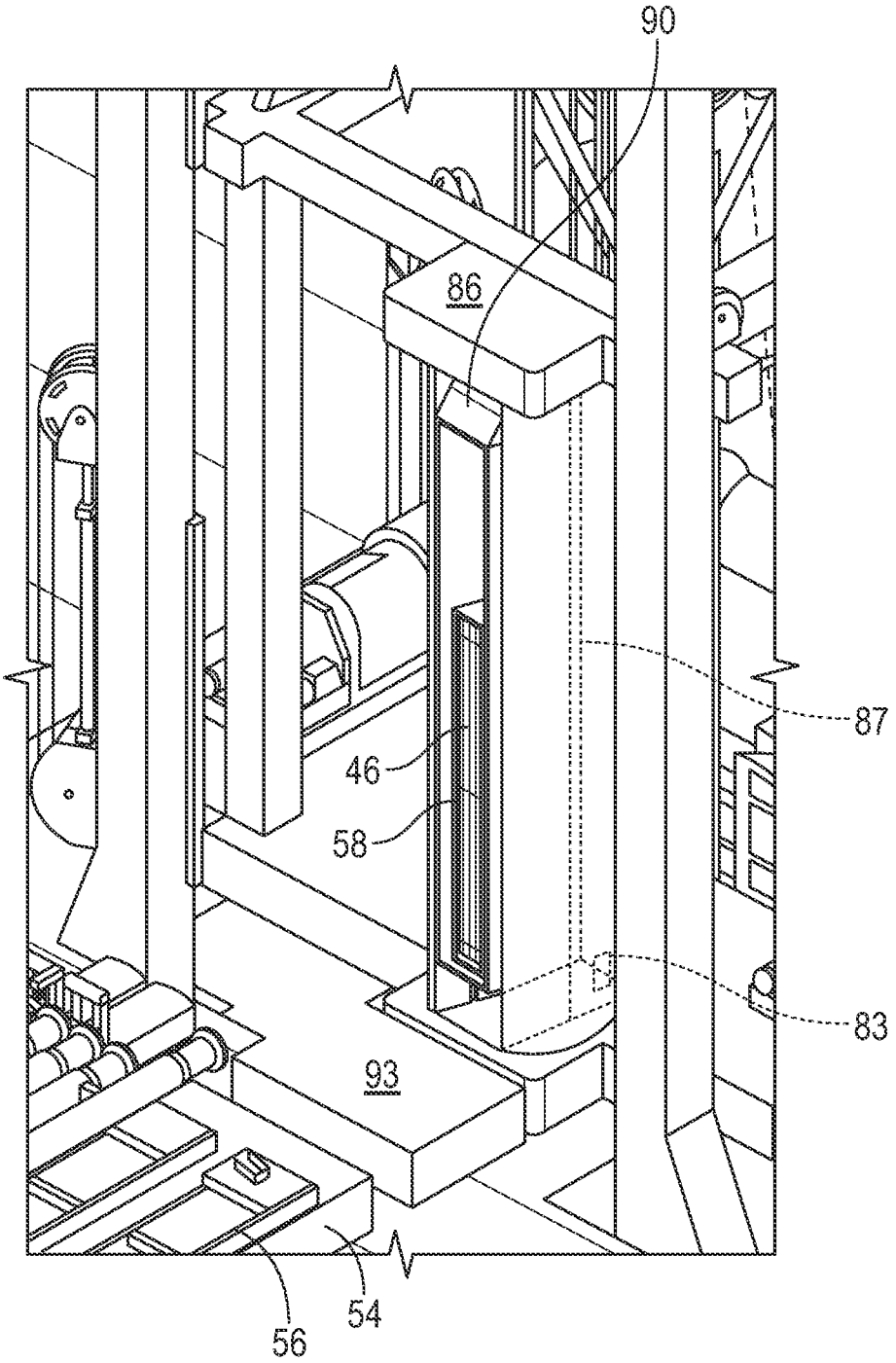
FIG. 8 illustrates an isometric view of the tubular housing in the enclosure of FIG. 5 disposed in both the lower portion and the upper portion of the lift and turn handler of FIG. 3, in accordance with an embodiment.

FIG. 7 illustrates the enclosure 58 as having been lifted from a horizontal to a semi-vertical position via the actuation device and/or system described above. Also illustrated in FIG. 7 is a support arm 96 that may extend from one or both of the sides of the cavity 88 (if more than one support arm is present). The support arm 96 extends from and is coupled to the enclosure 58. The connection between the support arm 96 and the enclosure 58 is releasable, in a manner at least similar to that described above with respect to reliable connections between the enclosure 58 and the lift and turn handler 86. In some embodiments, the support arm 96 may be coupled to the enclosure while disposed at a first position 98. The support arm 96 may then move in conjunction with (e.g., is synchronized with) the lifting of the topmost portion 90 of the enclosure 58 and may prevent a lower portion of the enclosure 58 from swinging as well as prevent the bottommost portion of the enclosure 58 from scraping across the transfer platform 93 as the enclosure 58 is placed within the cavity 88 of the lift and turn handler 86.

FIG. 8 illustrates the enclosure 58 fully within the lift and turn handler 86 and disposed in the vertical direction along the vertical axis 51. Once the enclosure 58 is in its vertical position inside of the cavity 88 of the lift and turn handler 86, the lift and turn handler 86 can be rotated, for example 180°, via a drive mechanism 85 (as illustrated in FIG. 7) or other actuation system or actuation device of the lift and turn handler 86 to place the tubular housing 46 (and the pipes 20 therein) in the drill floor 24 region of the drilling rig 60 to provide access to the tubulars. As previously discussed, because the lift and turn handler 86 includes a second cavity 87 that mirrors the cavity 88 described above, a second enclosure 58 holding an empty second tubular housing 46 (with the pipes 20 therein having been added to a pipe string). The lifting process may be reversed and the second enclosure 58 is lowered and moved onto the enclosure handler 54 and thereafter the empty second tubular housing 46 is removed by one or more robots 52. The one or more robots 52 may load a third tubular housing 46 (inclusive of its pipes 20) into the second enclosure. The lifting and turning of the second enclosure 58 is performed in the manner described above and when the lift and turn handler 86 rotates the second enclosure 58 to place the third tubular housing 46 (and the pipes 20 therein) in the drill floor 24 region of the drilling rig 60 to provide access to the tubulars, the first enclosure and first tubular housing (now empty) is exposed and ready for storage. This process can correspond to a tripping-in operation and the process can be reversed for a tripping-out process (i.e., empty tubular housing 46 are placed into the drill floor 24 region of the drilling rig 60, filled with pipes 20, rotated by the turn and lift device 86, lowered, stored and additional empty tubular housings 46 are lifted into the lift and turn handler 86 and transmitted to the drill floor 24 region of the drilling rig 60 to receive pipes 20 being removed from a pipe string). The operations described above may be controlled by a computing system, for example, a computing system communicatively coupled to a separate main control system in the control center 89 or a portion of the main control system (e.g., the control system present in the control center 89).

Figure 9:
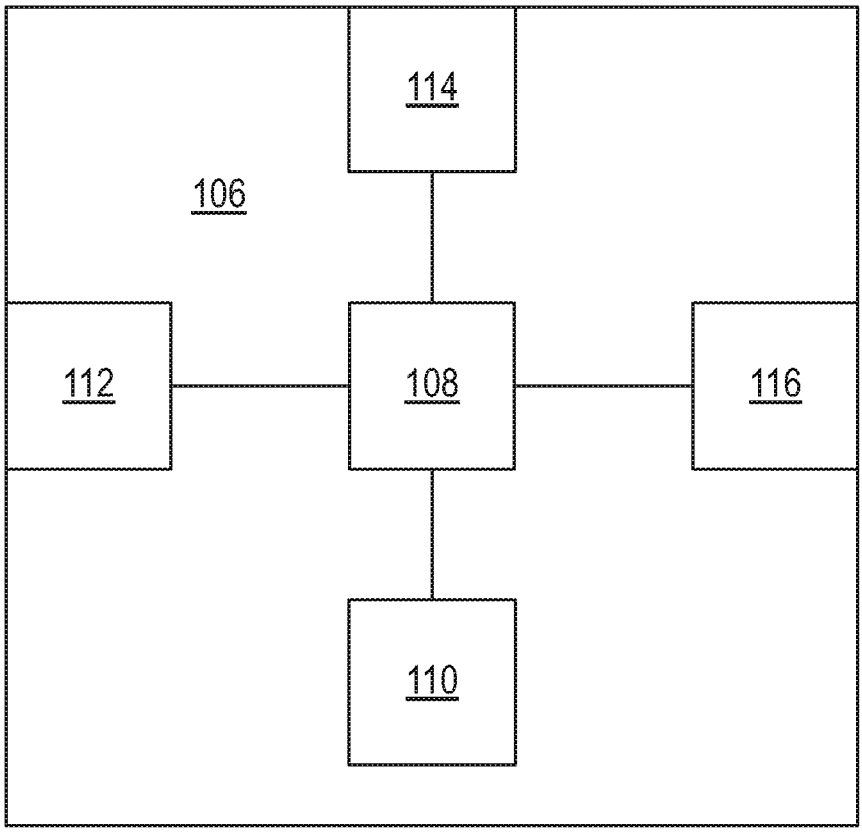
FIG. 9 illustrates a computing device used in conjunction with the lift and turn handler of FIG. 3, in accordance with an embodiment.

FIG. 9 illustrates a computing system 106, as referenced above. It should be noted that the computing system 106 may be a standalone unit (e.g., a control monitor) that may operate to generate output control signals (e.g., to form a control system). Likewise, the computing system 106 may be configured to operate in conjunction with, for example, one or more of the one or more robots 52, the enclosure handler 54, the enclosure 58, and/or the turn and lift device 86 (or any actuation device or activation system thereof). The computing system 106 may be a general purpose or a special purpose computer that includes a processing device 108, such as one or more application specific integrated circuits (ASICs), one or more processors, or another processing device that interacts with one or more tangible, non-transitory, machine-readable media (e.g., memory 110) of the computing system 106, which may operate to collectively store instructions executable by the processing device 108 to perform the methods and actions described herein. By way of example, such machine-readable media can comprise RAM. ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 108. In some embodiment, the instructions executable by the processing device 108 are used to generate, for example, control signals to be transmitted to, for example, one or more of the one or more of the one or more robots 52, the enclosure handler 54, the enclosure 58, the turn and lift device 86 (or any actuation device or activation system thereof), or a controller thereof, and/or a main control system (e.g., to be utilized in the control of the one or more of the one or more robots 52, the enclosure handler 54, the enclosure 58, and/or the turn and lift device 86 or any actuation device or activation system thereof) to operate in a manner described herein.

The computing system 106 may operate in conjunction with software systems implemented as computer executable instructions stored in a non-transitory machine readable medium of computing system 106, such as memory 110, a hard disk drive, or other short term and/or long term storage. Particularly, the processing device 108 may operate in conjunction with software systems implemented as computer executable instructions (e.g., code) stored in a non-transitory machine readable medium of computing system 106, such as memory 110, that may be executed to control the operation of the lift and turn handler 86. This information can be used by the computing system 106 (e.g., by the processing device 108 executing computer executable instructions stored in memory 110) to control the lifting, lowering, support, and rotation processes of the lift and turn handler 86.

In some embodiments, the computing system 106 may also include one or more input structures 112 (e.g., one or more of a keypad, mouse, touchpad, touch screen, one or more switches, buttons, or the like) to allow a user to interact with the computing system 106, for example, to start, control, or operate a graphical user interface (GUI) or applications running on the computing system 106 and/or to start, control, or operate at least the lift and turn handler 86. Additionally, the computing system 106 may include a display 114 that may be a liquid crystal display (LCD) or another type of display that allows users to view images generated by the computing system 106. The display 114 may include a touch screen, which may allow users to interact with the GUI of the computing system 106. Likewise, the computing system 106 may additionally and/or alternatively transmit images to a display of a main control system, which itself may also include a processing device 108, a non-transitory machine readable medium, such as memory 110, one or more input structures 112, a display 114, and/or a network interface 116.

Returning to the computing system 106, as may be appreciated, the GUI may be a type of user interface that allows a user to interact with the computer system 106 and/or the computer system 106 and one or more sensors that transmit data to the computing system 106 through, for example, graphical icons, visual indicators, and the like. Additionally, the computer system 106 may include the network interface 116 to allow the computer system 106 to interface with various other devices (e.g., electronic devices). The network interface 116 may include one or more of a Bluetooth interface, a local area network (LAN) or wireless local area network (WLAN) interface, an Ethernet or Ethernet based interface (e.g., a Modbus TCP, EtherCAT, and/or ProfiNET interface), a field bus communication interface (e.g., Profibus), a/or other industrial protocol interfaces that may be coupled to a wireless network, a wired network, or a combination thereof that may use, for example, a multi-drop and/or a star topology with each network spur being multi-dropped to a reduced number of nodes.

In some embodiments, one or more of the one or more robots 52, the enclosure handler 54, the enclosure 58, and/or the turn and lift device 86 (or any actuation device or activation system thereof) and/or a main control system may each be a device that can be coupled to the network interface 116. In some embodiments, the network formed via the interconnection of one or more of the aforementioned devices should operate to provide sufficient bandwidth as well as low enough latency to exchange all required data within time periods consistent with any dynamic response requirements of all control sequences and closed-loop control functions of the network and/or associated devices therein. It may also be advantageous for the network to allow for sequence response times and closed-loop performances to be ascertained, the network components should allow for use in oilfield/drillship environments (e.g., should allow for rugged physical and electrical characteristics consistent with their respective environment of operation inclusive of but not limited to withstanding electrostatic discharge (ESD) events and other threats as well as meeting any electromagnetic compatibility (EMC) requirements for the respective environment in which the network components are disposed). The network utilized may also provide adequate data protection and/or data redundancy to ensure operation of the network is not compromised, for example, by data corruption (e.g., through the use of error detection and correction or error control techniques to obviate or reduce errors in transmitted network signals and/or data).

Figure 10:
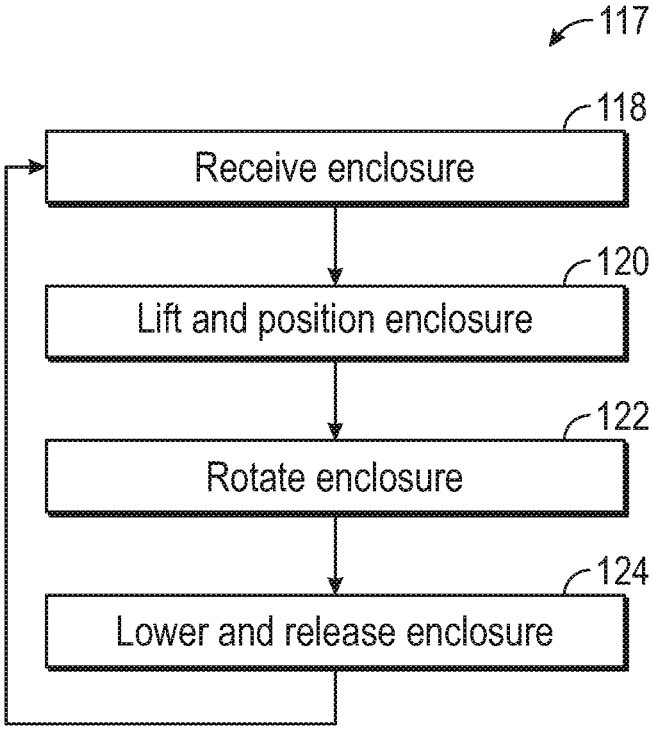
FIG. 10 illustrates a flow diagram of the lift and turn handler of FIG. 3, in accordance with an embodiment.

The computing system 106 may be involved in operations involving the lift and turn handler 86. FIG. 10 illustrates one such operation 117. In step 118, the enclosure 58 can be received by the lift and turn handler 86. The computing system 106 may operate to generate and/or transmit control signals or other signals that cause, for example, the enclosure 58 to be positioned within the cavity 88 by the enclosure handler 54. Likewise, the computing system 106 may operate to generate and/or transmit control signals or other signals that cause, for example, the enclosure 58 to be coupled to or otherwise secured to the lift and turn handler 86 (as well as release the enclosure 58 from the lift and turn handler 86 when it is removed therefrom subsequently).

In step 120, the enclosure 58 is lifted and positioned within the lift and turn handler 86. The computing system 106 may operate to generate and/or transmit control signals or other signals that cause, for example, the enclosure 58 to be lifted via an actuation device and or an actuation system of the lift and turn handler 86 (as well as lowered when the enclosure 58 is being removed from the lift and turn handler 86 subsequently). Additionally the computing system 106 in step 120 may operate to generate and/or transmit control signals or other signals that cause, for example, the support arm 96 to extend, engage, and to travel in a vertical direction along the vertical axis 51 of the cavity 88 (as well as retract, disengage and travel in a vertical direction along the vertical axis 51 of the cavity 88 when the enclosure 58 is being removed from the lift and turn handler 86 subsequently).

In step 122, the enclosure 58 is rotated via the lift and turn handler 86. In some embodiments, this rotation of, for example 180°, may be accomplished by the computing system 106 operating to generate and/or transmit control signals or other signals that cause, for example, the lift and turn handler 86 to be rotated by a predetermined amount via an actuation device and or an actuation system of the lift and turn handler 86 (as well as subsequently rotated by the predetermined amount when the enclosure 58 is being removed from the lift and turn handler 86).

Finally, in step 124, the enclosure 58 is lowered and released from the lift and turn handler 86. As noted above, the computing system 106 can operate to generate and/or transmit control signals or other signals that cause, for example, the enclosure 58 to be lowered via an actuation device and or an actuation system of the lift and turn handler 86, the support arm 96 to retract, disengage, and to travel in a vertical direction along the vertical axis 51 of the cavity 88 as part of step 124. Likewise, the computing system 106 can operate to generate and/or transmit control signals or other signals that cause, for example, the one or more connectors 94 of the lift and turn handler 86 to disengage from the interface 92 to release the enclosure 58 in step 124. Thereafter, the process can be repeated. Moreover, this process can be applied to either a tripping-in or a tripping-out operation or any other operation that requires addition of or removal of tubulars by the drilling rig 60.

The present disclosure describes techniques and components to stabilize and support tubular housing 46, risers, or other tubulars in an enclosure 58 as well as to transport the enclosure via a lift and turn handler 86 that operates to both move the enclosure 58 between vertical and horizontal positions as well as rotate the enclosure 58 into and out of a region of a drill floor 24. These above described techniques and devices operate to accelerate operations of the drilling rig 60 that involve, for example, addition or removal of tubulars from a string.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a first cavity sized to hold a first cassette of tubulars;

a second cavity sized to hold a second cassette of tubulars;

a first lifting actuator disposed in the first cavity, wherein the first lifting actuator when in operation lifts the first cassette of tubulars from a horizontal orientation to a vertical orientation with respect to a drill floor;

a second lifting actuator disposed in the second cavity, wherein the second lifting actuator when in operation lifts the second cassette of tubulars from the horizontal orientation to the vertical orientation; and a driver that when in operation rotates the device by a predetermined amount to dispose the first cavity in a region directly proximate to the drill floor.

2. The device of claim 1, wherein the first cavity comprises one or more connectors configured to interface with an enclosure housing the first cassette of tubulars.

3. The device of claim 2, wherein the one or more connectors restrict lateral movement of the enclosure housing the first cassette of tubulars when engaged with the enclosure.

4. The device of claim 2, wherein the first lifting actuator vertically moves the one or more connectors in the first cavity to lift the first cassette of tubulars from the horizontal orientation to the vertical orientation with respect to the drill floor.

5. The device of claim 2, comprising a support arm disposed within the first cavity and that when in operation extends from the first cavity to couple the support arm to the enclosure.

6. The device of claim 5, wherein the support arm in operation moves vertically with respect to the drill floor in conjunction with the lifting of the first cassette of tubulars from the horizontal orientation to the vertical orientation with respect to the drill floor.

7. The device of claim 1, wherein the second cavity comprises one or more connectors configured to interface with an enclosure housing the second cassette of tubulars.

8. The device of claim 7, wherein the second lifting actuator vertically moves the one or more connectors in the second cavity to lift the second cassette of tubulars from the horizontal orientation to the vertical orientation with respect to the drill floor.

9. The device of claim 7, comprising a support arm disposed within the second cavity and that when in operation extends from the second cavity to couple the support arm to the enclosure.

10. The device of claim 9, wherein the support arm in operation moves vertically with respect to the drill floor in conjunction with the lifting of the second cassette of tubulars from the horizontal orientation to the vertical orientation with respect to the drill floor.

11. The device of claim 1, wherein the driver when in operation rotates the device by the predetermined amount to dispose the second cavity in a second region away from the drill floor.

12. A device, comprising:

a first cavity sized to hold an entirety of an enclosure having at least one tubular wholly disposed therein;

one or more connectors disposed in the first cavity, wherein the one or more connectors when in operation releasably couple the enclosure to the first cavity via one or more interfaces of the enclosure;

a lifting actuator that when in operation lifts the enclosure from a horizontal orientation to a vertical orientation with respect to a drill floor; and a driver that when in operation rotates the first cavity by a predetermined amount to dispose the enclosure in a region directly proximate to the drill floor.

13. The device of claim 12, comprising a second cavity sized to hold a second enclosure having at least one second tubular therein.

14. The device of claim 13, wherein the lifting actuator when in operation lifts the second enclosure from the horizontal orientation to the vertical orientation with respect to the drill floor.

15. The device of claim 13, comprising a second lifting actuator that when in operation lifts the second enclosure from the horizontal orientation to the vertical orientation with respect to the drill floor.

16. The device of claim 13, wherein the driver when in operation rotates the second cavity by the predetermined amount to remove the second enclosure from the region directly proximate to the drill floor.

17. A tangible, non-transitory computer-readable medium having computer executable code stored thereon, the computer executable code comprising instructions to cause a processor to:

generate a first control signal to receive an enclosure having at least one tubular therein by a lift and turn handler;

generate a second control signal to cause, via the lift and turn handler, lift and positioning of the enclosure inside of a cavity of the lift and turn handler from a horizontal orientation to a vertical orientation with respect to a drill floor; and generate a third control signal to cause rotation of the lift and turn handler by a predetermined amount to dispose the enclosure in a region directly proximate to the drill floor.

18. The tangible, non-transitory computer-readable medium of claim 17, wherein the computer executable code comprises instructions to cause the processor to generate a fourth control signal to cause lowering and positioning of a second enclosure in a second cavity of the lift and turn handler from the vertical orientation to the horizontal orientation with respect to the drill floor.

19. The tangible, non-transitory computer-readable medium of claim 18, wherein the computer executable code comprises instructions to cause the processor to generate the fourth control signal subsequent to the rotation of the lift and turn handler by the predetermined amount.

20. The tangible, non-transitory computer-readable medium of claim 18, wherein the computer executable code comprises instructions to cause the processor to generate a fifth control signal to cause lift and positioning of the second enclosure having at least one second tubular therein within the second cavity of the lift and turn handler from the horizontal orientation to the vertical orientation with respect to the drill floor subsequent to generation of the fourth control signal.

* * * * *